United States Patent [19]

Lautenschläger, Jr.

[11] 4,240,179

[45] Dec. 23, 1980

[54] HINGE FOR CABINET DOORS

[75] Inventor: Karl Lautenschläger, Jr., Reinheim, Fed. Rep. of Germany

[73] Assignee: Karl Lautenschläger KG, Mobelbeschlagfabrik, Reinheim, Fed. Rep. of Germany

[21] Appl. No.: 956,414

[22] Filed: Oct. 31, 1978

[30] Foreign Application Priority Data

Dec. 3, 1977 [DE] Fed. Rep. of Germany ..... 2753904

[51] Int. Cl.[3] ..... E05D 11/10

[52] U.S. Cl. ..... 16/139; 16/163; 292/73

[58] Field of Search ..... 16/139, 140, 141, 142, 16/145, 163, 164, 165, 166, DIG. 32; 292/341.17, 341.13, 193, 73

[56] References Cited

U.S. PATENT DOCUMENTS

| | | | |
|---|---|---|---|
| 2,805,442 | 9/1957 | Ragsdale | 16/139 X |
| 3,081,117 | 3/1963 | McDaniel | 16/DIG. 32 |
| 3,155,411 | 11/1964 | Sandor | 16/DIG. 32 |
| 3,893,209 | 7/1975 | Sewing et al. | 16/164 |

FOREIGN PATENT DOCUMENTS

| | | | |
|---|---|---|---|
| 1845743 | 1/1962 | Fed. Rep. of Germany . | |
| 2324288 | 12/1973 | Fed. Rep. of Germany | 16/163 |
| 2122857 | 5/1974 | Fed. Rep. of Germany . | |
| 2536744 | 6/1976 | Fed. Rep. of Germany | 16/145 |
| 2516084 | 10/1976 | Fed. Rep. of Germany | 16/163 |
| 2524504 | 12/1976 | Fed. Rep. of Germany | 16/163 |
| 2001684 | 1/1978 | Fed. Rep. of Germany | 16/163 |

*Primary Examiner*—C. J. Husar
*Assistant Examiner*—Moshe I. Cohen

[57] ABSTRACT

Hinge for cabinet doors, which has two hinge mounting parts joined by a linkage mechanism, the one hinge mounting part being in the form of a cup which can be recessed into a mortise in the cabinet door, and in which a resilient snap-catch element is provided, while the mounting part has in the area of its extremity extending into the cup a catch projection which during the closing movement of the hinge is engaged by the snap-catch element and behind which it is arrested in the closed position. The snap-catch element is a roller of resiliently compressible material mounted stationary in the wall of the insert cup.

5 Claims, 4 Drawing Figures

HINGE FOR CABINET DOORS

BACKGROUND

The invention relates to a hinge for cabinet doors which has two parts joined together by a linkage mechanism, the one part being in the form of a cup which can be set in a mortise in the cabinet door and contains a resilient snap catch, while the other part has adjacent its extremity that extends into the cup a projection which is engaged by the snap catch in the course of the closing movement and behind which it is arrested in the closed position.

Such cabinet hinges with self-contained catch mechanism for the secure retention of the cabinet door in the closed position are known in many different forms. The resilient snap catch disposed in the cup is, in a known hinge (German Petty Pat. No. 1,845,743) for example, formed of a metal ball which is biased by a spring to a position in which it projects partially into the interior of the cup and can be forced back against the spring bias into the wall of the cup. This ball catch is forced back in the closing movement by a counter-surface on the other part of the hinge, and when the closed position is reached it snaps behind the counter-surface into a recess. In another known over-center hinge (German Federal Pat. No. 21 22 857), the resilient element is formed by an elongated tongue mounted pivotingly in the cup and biased by a spring to a position in which it projects slantingly into the cup; in the closing movement it is first forced back by the counter-surface of the other part of the hinge to a dead center position from which a partial relaxation of the spring drives the counter-surface and hence the second hinge part to the closed position. These and other similar known hinges function satisfactorily and are widely used in modern furniture construction. It has been found to be a certain disadvantage, however, that the disposition of the snap catch and especially of the spring biasing it necessitates an increase in the size of the cup, in the form, for example, of a housing projection which is situated above the inner door surface and contains the spring. Furthermore, in the assembly of the hinges, the snap catches have to be installed against the bias of the spring urging them to the catching position, or else the spring has to be installed in the cup afterward, under bias. This requires much work and the hinges are therefore more expensive to manufacture.

THE INVENTION

The object of the invention is to create a snap-catch mechanism which will be of substantially simplified construction and will be improved with regard to the cost involved in the purchase of the components and in their assembly, and which, furthermore, will provide operation that is just as reliable while requiring so little space that the cup can be made in the same dimensions as a cup that is designed for hinges containing no snap-catch mechanism.

Setting out from a hinge of the initially mentioned kind, this object is achieved in accordance with the invention by making the snap catch in the form of a roller of resiliently compressible material mounted stationary in the wall of the cup. In this roller of resiliently compressible material, therefore, there are combined the function of the above-mentioned metal ball and that of the corresponding compression spring or of the pivoting tongue and corresponding spring, thereby achieving the desired saving of space and simplification of design.

Resilient materials which can be considered for the production of the roller often have a relatively high coefficient of friction. To assure that the snap-action mechanism will perform precisely, regardless of the material used for the roller, it is desirable to mount the roller for rotation on a pin set in the wall of the cup, it being also desirable to line the journal bore of the roller with a metal bushing.

The roller serving as the snap catch is preferably disposed partially within a recess in the wall of the cup. In addition to the saving of space, this brings it about that the snap action mechanism is not even visible, so that the hinge of the invention can, if necessary, also be combined with externally identical hinges containing no snap-action mechanism.

The roller serving as the snap-action means can be made either of rubber having a resiliency adjusted to the desired snap action, or of a sufficiently resilient and aging-resistant plastic, preferably polyurethane.

The invention is further explained in the following description of an embodiment, in conjunction with the drawing wherein.

Figure 1:
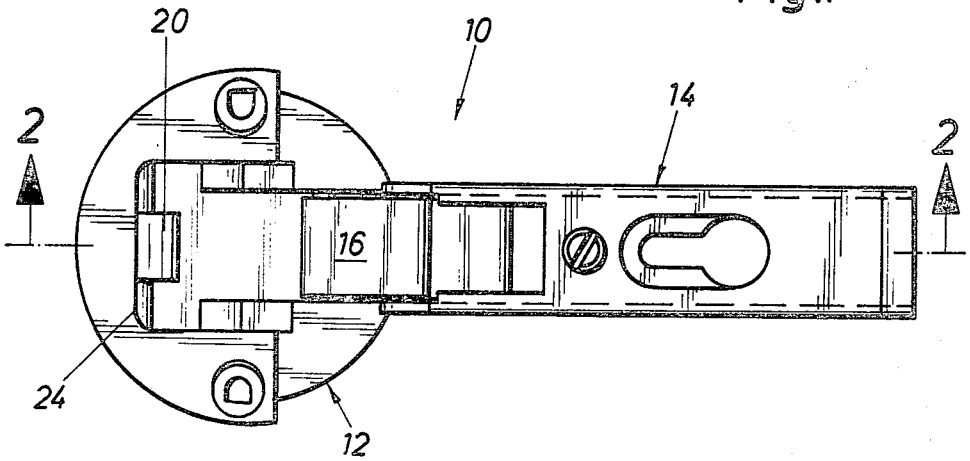
FIG. 1 is a top plan view of a hinge in accordance with the invention in the open position.
Figure 2:
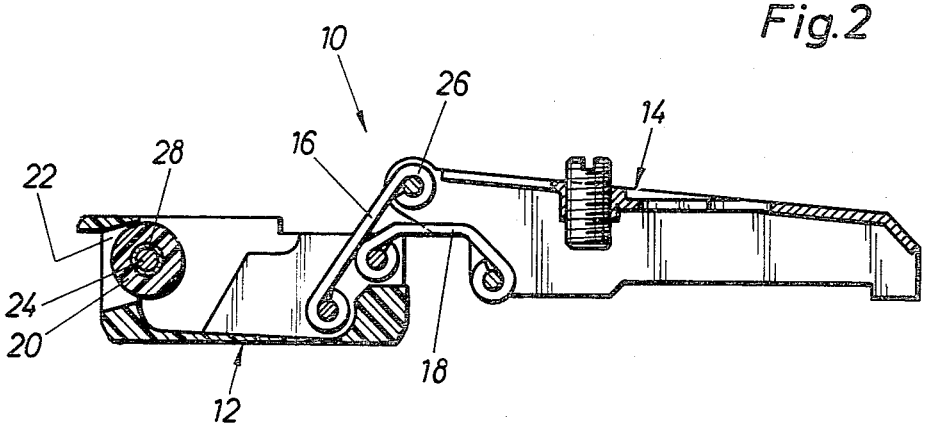
FIG. 2 is a cross-sectional front elevation, representing a view in the direction of the arrows 2—2 of FIG. 1.
Figure 3:
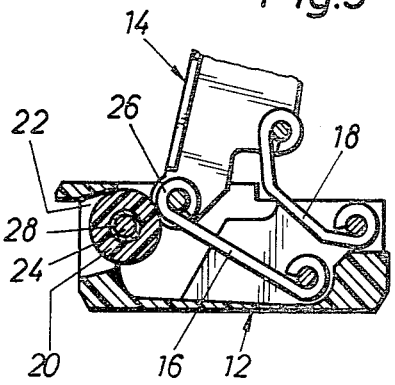
FIG. 3 is a partial cross-sectional elevation of the hinge of the invention, corresponding to FIG. 2, in which the snap catch element is seen engaging the corresponding counter-surface in the closing movement.
Figure 4:
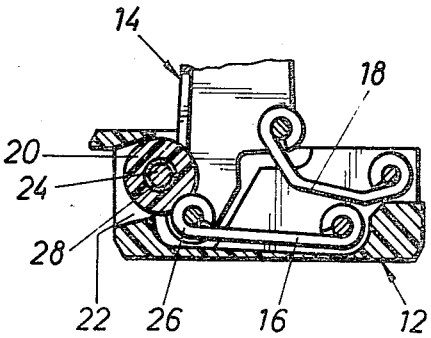
FIG. 4 is a cross-sectional elevation corresponding to FIG. 3, in which the hinge of the invention is shown in the closed position.

The hinge of the invention which is shown in FIGS. 1 to 4 and designated as a whole by the number 10 is, in the illustrated example, what is known as a four-joint hinge, in which the part that is to be attached to the cabinet door is in the form of a cup 12 which is to be hammered or inserted into a matching mortise in the cabinet door (not shown), and is joined by two hinge links 16 and 18 to the part which is to be attached to the wall, and which is in the form of an elongated supporting arm 14. The supporting arm 14 is mounted on the side wall of a cabinet in a known manner by attaching it to a mounting plate (which is not shown) fastened to the side wall. Up to this point the hinge 10 is the same as conventional four-joint hinges.

The snap-action mechanism holding the hinge 10 in the closed position (FIG. 4) is formed essentially of a roller 20 of resiliently compressible material, such as rubber or polyurethane plastic, for example, which is rotatably mounted on a pin 24 in a recess 22 in the wall of the cup 12. The roller 20 is so disposed in the cup that a portion of its cylindrical surface projects into the path of movement of the joint eye 26 on the supporting arm end of the hinge link 16. In the closing movement of the hinge, the joint eye 26 therefore will encounter the roller 20 in the position represented in FIG. 3 and will compress it as the closing movement continues until a dead center position is reached, after which the roller will again be partially relieved of compression until it reaches the closed position. The residual compression of the roller 20 will assure the rattle-free detention of the door in the end position.

In order to assure that the snap-action mechanism will operate as precisely as possible regardless of the friction forces between the periphery of the roller 20 and the bearing eye 26 or between the roller 20 and the pin 24, the journal bore of the roller 20 is lined with a metal bushing 28, which assures easy rotation on the pin 24 independently of the compression on the roller 20.

In addition to its simplicity of construction, which can be seen at a glance, the hinge of the invention has the advantage that no part of the snap-catch mechanism has to be installed under tension, and this appreciably simplifies installation in comparison to the known hinges which operate with biasing springs.

The hinge of the invention has been described above in detail in conjunction with a four-joint hinge, but it is apparent that the snap-catch mechanism can be used also in hinges of different types of joints, such as single-joint hinges, cross-linkage hinges and the like, provided that, in the closed position, a portion of the supporting wall part of the hinge or a component connected to the supporting wall part, is situated in the interior of the cup, and a snap-action projection cooperating with the resilient roller can be provided on this part.

I claim:

1. A hinge for cabinet doors, said hinge being movable from a closed position to an open position and vice versa, and comprising: two hinge mounting parts, a linkage mechanism joining said parts, one hinge mounting part being in the form of a cup having a wall with a recess and adapted to be recessed into a mortise in the cabinet door, a resilient snap-catch element mounted stationary in the wall of said cup in part within said recess, the other hinge mounting part having an extremity extending into said cup in said closed position and having a catch projection in the area of said extremity which during the closing movement of the hinge is engaged by the snap-catch element and behind which it is arrested in the closed position, said snap-catch element being a roller made of resiliently compressible material.

2. A hinge according to claim 1, comprising a pin held in the wall of said cup and wherein said roller is rotatably mounted on said pin.

3. A hinge according to claim 2, comprising a metal sleeve journalling said roller on said pin.

4. A hinge according to any one of claims 1 to 3, wherein said roller is made of rubber.

5. A hinge according to any one of claims 1 to 3, wherein said roller is made of a sufficiently resilient and aging-resistant plastic, such as polyurethane.

* * * * *